US008122684B2

(12) United States Patent
Kurz et al.

(10) Patent No.: US 8,122,684 B2
(45) Date of Patent: Feb. 28, 2012

(54) TRANSPORT SYSTEM FOR HANDLING MULTI-WIDTH FLEXIBLE POUCHES

(75) Inventors: Michael Kurz, Muhlhausen (DE); Stefan Muller, Obrigheim-Asbach (DE); Hans-Peter Wild, Eppelheim (DE)

(73) Assignee: INDAG Gesellschaft für Industriebedarf mbH & Co. Betriebs KG, Eppelheim (DE)

( * ) Notice: Subject to any disclaimer, the term of this patent is extended or adjusted under 35 U.S.C. 154(b) by 155 days.

(21) Appl. No.: 12/432,269

(22) Filed: Apr. 29, 2009

(65) Prior Publication Data

US 2009/0272074 A1 Nov. 5, 2009

(30) Foreign Application Priority Data

May 2, 2008 (EP) ..... 08008368

(51) Int. Cl.
*B65B 43/26* (2006.01)

(52) U.S. Cl. ..... 53/284.7; 53/384.1; 53/468

(58) Field of Classification Search ..... 53/266.1, 53/267, 284.7, 284, 376.3, 377.7, 377.8, 53/378.3, 468, 384.1
See application file for complete search history.

(56) References Cited

U.S. PATENT DOCUMENTS

| | | | | |
|---|---|---|---|---|
| 3,812,649 | A * | 5/1974 | Clancy | 53/564 |
| 4,108,300 | A * | 8/1978 | Hayase et al. | 198/626.6 |
| 4,263,768 | A * | 4/1981 | Russell et al. | 53/384.1 |
| 4,423,583 | A * | 1/1984 | Carey | 52/373 |
| 5,058,364 | A * | 10/1991 | Seiden et al. | 53/455 |
| 5,182,898 | A * | 2/1993 | Tung et al. | 53/570 |
| 5,673,541 | A * | 10/1997 | Arzuman et al. | 53/459 |
| 5,862,653 | A * | 1/1999 | Solano | 53/562 |
| 6,050,061 | A * | 4/2000 | Todd et al. | 53/455 |
| 6,073,424 | A * | 6/2000 | Kraft et al. | 53/570 |
| 6,931,824 | B2 * | 8/2005 | Rogers | 53/570 |

FOREIGN PATENT DOCUMENTS

| | | |
|---|---|---|
| DE | 2622291 | 12/1976 |
| DE | 10 2006 028 796 | 12/2007 |
| WO | 2006/111139 A | 10/2006 |

OTHER PUBLICATIONS

European Search Report from European Patent Application No. 08 00 8368.6.

* cited by examiner

*Primary Examiner* — Paul Durand
(74) *Attorney, Agent, or Firm* — Stroock & Stroock & Lavan LLP

(57) ABSTRACT

A flexible bag transport system for transporting flexible filling and sealing station which includes a pair of holding clamp assemblies opposed to each other for holding the top end of a bag. The first clamp assembly is supported by a first elongated carrier and a second clamp assembly is supported by a second elongated carrier that is parallel to the first carrier. Clamping assemblies remain apart from each other and the bags are transported and are displaced toward each other to permit the bag to be opened during filling of the bag. One of the elongated carriers supporting the clamping assemblies has an adjustable mechanism so that the clamp assemblies can be adjusted with respect to each other without requiring adjustment of the remaining components of the transport system.

6 Claims, 5 Drawing Sheets

TRANSPORT SYSTEM FOR HANDLING MULTI-WIDTH FLEXIBLE POUCHES

FIELD OF THE INVENTION

The present invention relates generally to a transport system for transporting foil bags through opening and sealing stations and in particular, to an adjustable mechanism that permits multi-width flexible bags to be transported through different handling stations.

BACKGROUND OF THE INVENTION

A flexible bag transport systems for moving a flexible foil pouch through an opening station, a filling station and a closing station is described in detail in U.S. Pat. No. 6,073,424, which is incorporated by reference as if fully set forth herein. Such transport systems have clamping assemblies to hold the pouches taught and to permit the foil pouches that are filled with beverages to be opened and closed as the flexible bags are transported through the filling station.

U.S. Pat. No. 6,073,424 describes a typical transport system wherein two clamping assemblies engage the pouch collaterally by clamping the side scams of the pouch on each side in order to hold the pouch firmly as the pouch is transported to each of the handling stations. These clamping assemblies have a distance relative to each other which is precisely selected to the width of the pouch from side seam to side seam so that the pouch extends between the two clamping means without any slack so that the side seams are pulled apart to make the pouch taut on a straight line. This causes the pouch to be closed on the upper transverse side of the pouch extending from side seam to side seam so that the front side and rear side foils of the pouch remain closed and can be welded or sealed together.

For filling purposes, the holding clamps move toward each other so that the front side panel and the rear side panel of the foil pouches undergo an outward bend to define an opening for permitting access to the opening for filling the pouch. After the pouch is filled, the holding clamps move apart from each other so that the front and rear side of the foil pouches are again held taught in a closed position for subsequent welding of the closed panels at the top edge thereof.

Heretofore in systems where the pouches are suspended by holding clamps, the movement of the holding clamps toward each other and away from each other is controlled automatically by a guide crank or cam and cam follower respectively. In order to achieve the proper handling, opening and sealing it is important that the distance between the holding clamps of the pouch are precisely registered with the width of the pouch to allow a precisely controlled closing and opening of the pouch at the top thereof. In order to maintain this arrangement, transport systems have been designed for a single width pouch to assure that spacing between the side seams is maintained with precision. Also, this type of transport system is also limited to the transport of freely suspended smaller pouches, i.e., pouches that are not of considerable length, when measured along the lateral edges, because the holding clamps must be designed in a complex manner to permit the pouches to be securely held, filled, sealed, etc. Accordingly, a transport system that provides for the ability to transport pouches of varying widths and heights without losing the efficiency of known clamping assemblies would be desirable.

SUMMARY OF THE INVENTION

Generally speaking in accordance with the invention, a flexible bag transport system for transporting flexible foil bags from a closed position to an open position at a filling station and to a closed positing at a sealing station is provided. The system includes a pair of holding clamp assemblies opposed to each other for holding the top end of the flexible foil bag at the transverse sides thereof the first holding clamp being supported by a first elongated carrier and the second holding clamp assembly being supported by a second elongated carrier that is parallel to the first elongated carrier. The first and second elongated carriers are disposed on parallel runners so that the holding clamp assemblies are positioned in a manner to be spaced apart so that opposed clamping assemblies hold the top transverse edges of the foil bag in a first position where the bag is held tight and closed at a sealing station when the carriers are displaced in a first position with respect to each other and where the bag is opened to permit filling of the bag when the clamping assemblies are moved toward each other, the length of the first elongated carrier is adjustable to accommodate different pouch widths, without requiring adjustment of the receiving components of the holding clamp assembly.

Accordingly, it is an object of this invention to provide an improved transport system that allows for the transport of flexible pouches of different dimensions.

It is a further object of the instant invention to provide an improved transport system for permitting pouches of different width dimensions to be properly transported to different handling stations during filling and sealing.

It is still a further object of the instant invention to provide side and bottom carriers that are adjustable relative to each other to permit for the transport of pouches of different widths and heights.

Additional features and advantages of the present invention are described further below. This summary section is meant merely to illustrate certain features of the invention. It is not meant to limit the scope of the invention in any way. The failure to discuss a specific feature or embodiment of the invention or the inclusion of one or more features in this summary section, should not be construed to limit the invention as claimed.

BRIEF DESCRIPTION OF THE DRAWINGS

The foregoing summary, as well as the following detailed description of the preferred embodiments of the application, will be better understood when read in conjunction with the appended drawings. For the purpose of illustrating the device of the present application there is shown in the drawings preferred embodiments. It should be understood, however, that the application is not limited to the precise arrangements and instrumalities shown. In the drawings.

DETAILED DESCRIPTION OF THE PREFERRED EMBODIMENTS

Figure 1:
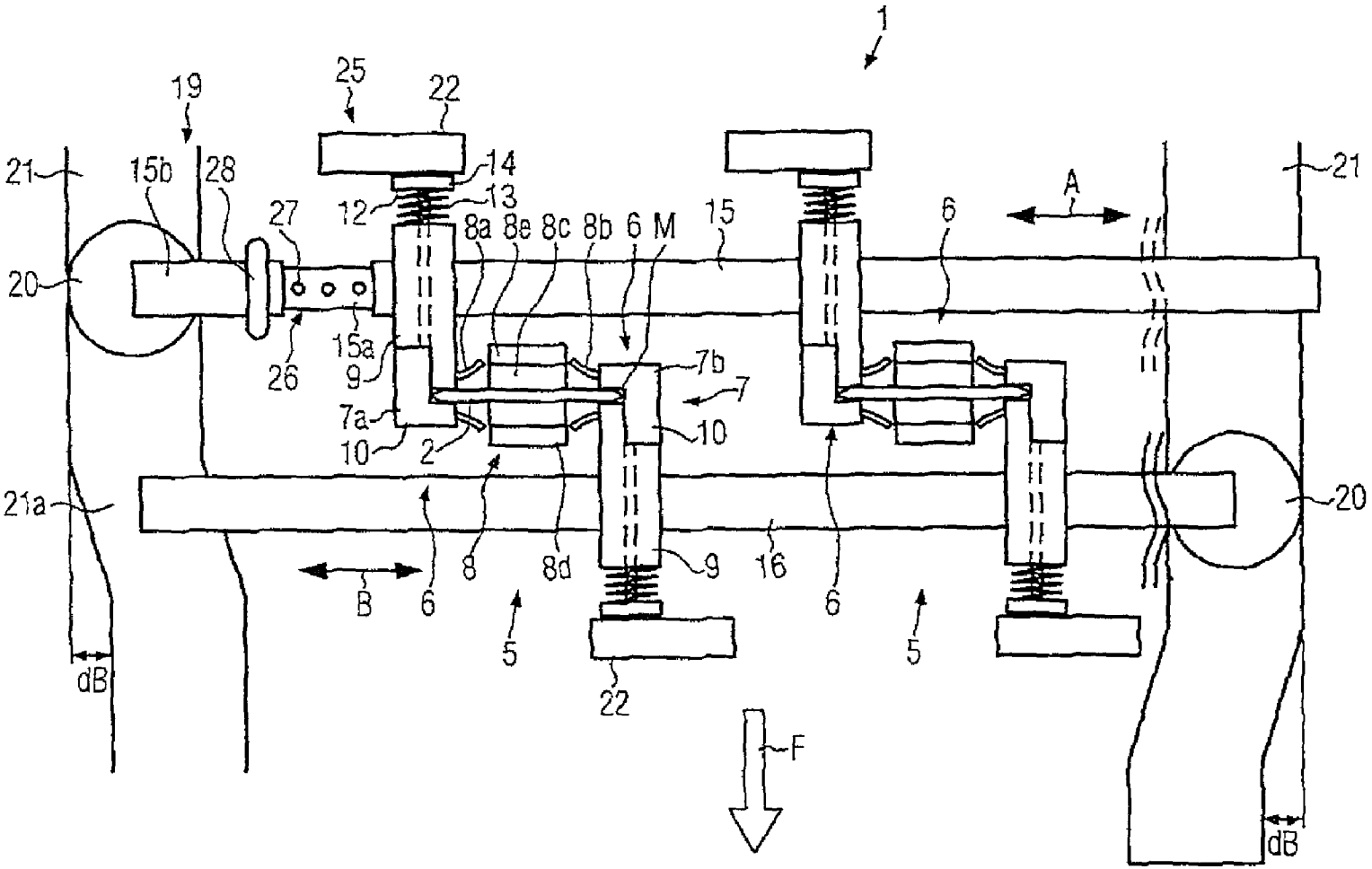
FIG. 1 is a top plan detailed view of the associated carrier structures in accordance with a preferred embodiment of the instant invention.
Figure 2:
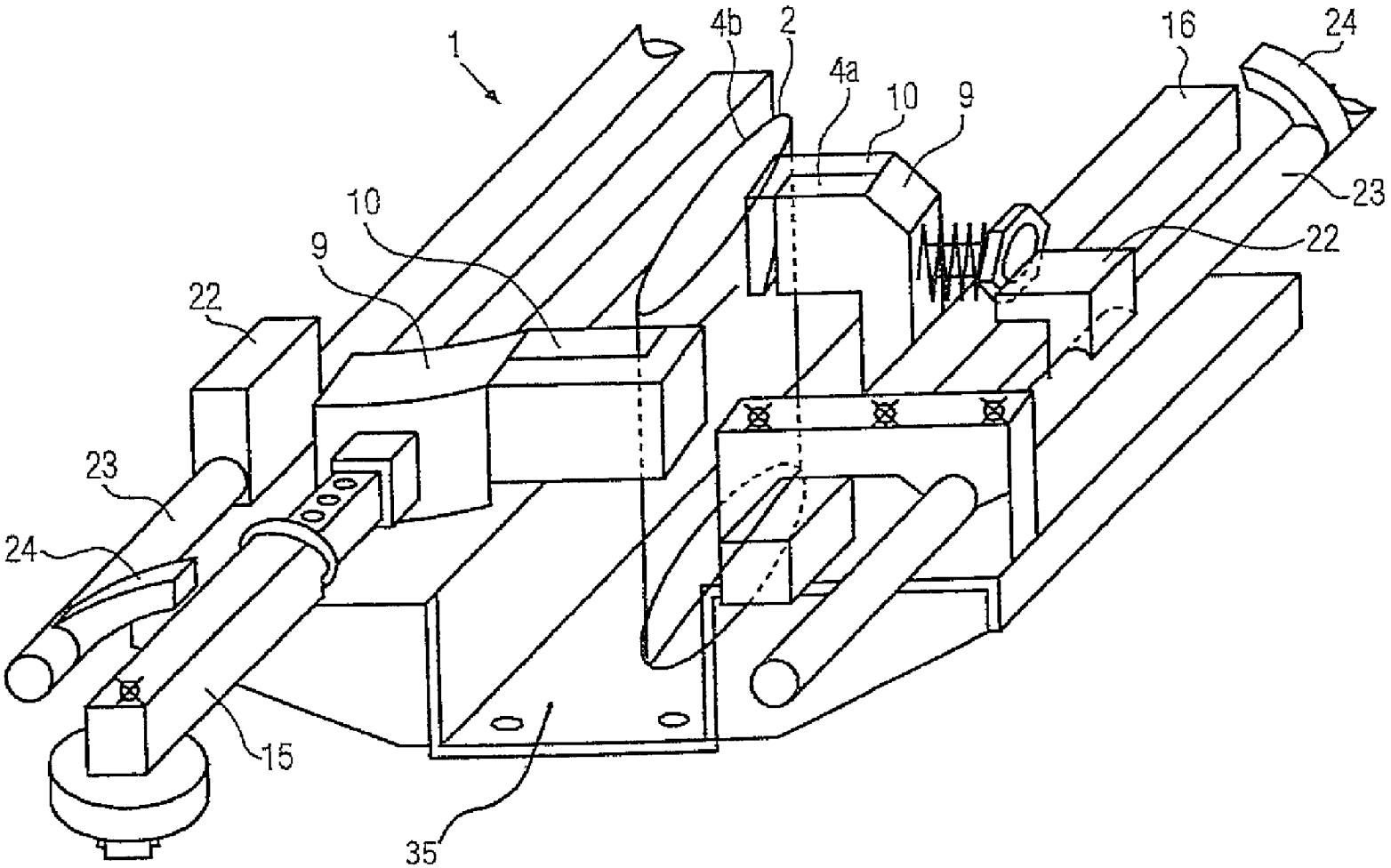
FIG. 2 shows a perspective view of a portion of the associated carrier structures depicted in FIG. 1.

Reference is first made to FIGS. 1 and 2 wherein a detailed arrangement of the operative components of the transport system 1 for handling flexible pouches 2 in accordance with the instant invention is depicted. In an exemplary embodiment, the pouches are foil pouches of the type used for beverages or the like which are produced from foil blanks the edges of which are welded together to create the pouch.

Figure 3B:
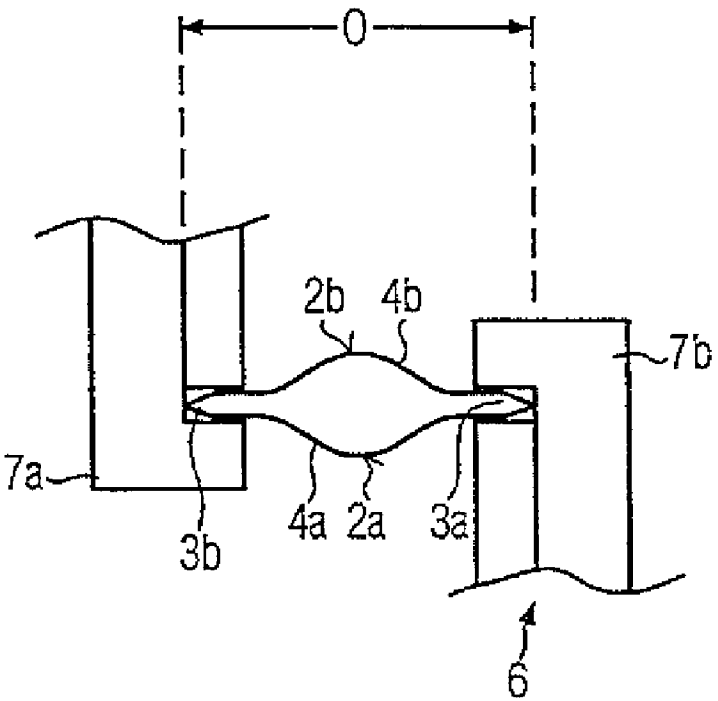
FIGS. 3*a* and 3*b* are top views showing examples of a the holding clamping assemblies positioning the foil bags in a closed position and open position, respectively.

Specifically, each flexible beverage pouch 2 is comprised of the two opposite side walls 2*a* and 2*b* (see FIGS. 3*a* and 3*b*) which are welded together by lateral seams 3*a* and 3*b*. The upper edges 4*a* and 4*b* of the sidewalls 2*a* and 2*b* extend transversely to the side seams 3*a* and 3*b* to define the top opening of the package. As depicted in FIG. 3*b*, when the top edges of sidewalls 2*a* and 2*b* are displaced toward each other, they will form an opening to permit the bag to be filled. In an exemplary embodiment, the pouch 2 will include a wider base on the edges opposite to the upper edges of 4*a* and 4*b*. Typically, to close the pouch the sidewalls 2*a* and 2*b* are made of foil and are welded together at the edges 4*a* and 4*b*. In an additional embodiment, any type of pouch that permits for the top edges to be moved to an open and to a closed position by the clamping assemblies being displaced toward and away from each other would be suitable for use with the transport system of the instant invention.

In the exemplary embodiment depicted in FIGS. 1 and 2, the system is designed to transport the flexible pouches through different handling stations, such as a filling station wherein the pouch is opened and filled and a welding station for sealing the upper edges 4*a* and 4*b* of a foil pouch together. Accordingly, with the exception of the improvements set forth and described herein, the transport system corresponds to the transport system described and claimed in U.S. Pat. No. 6,073,424.

Figure 4:
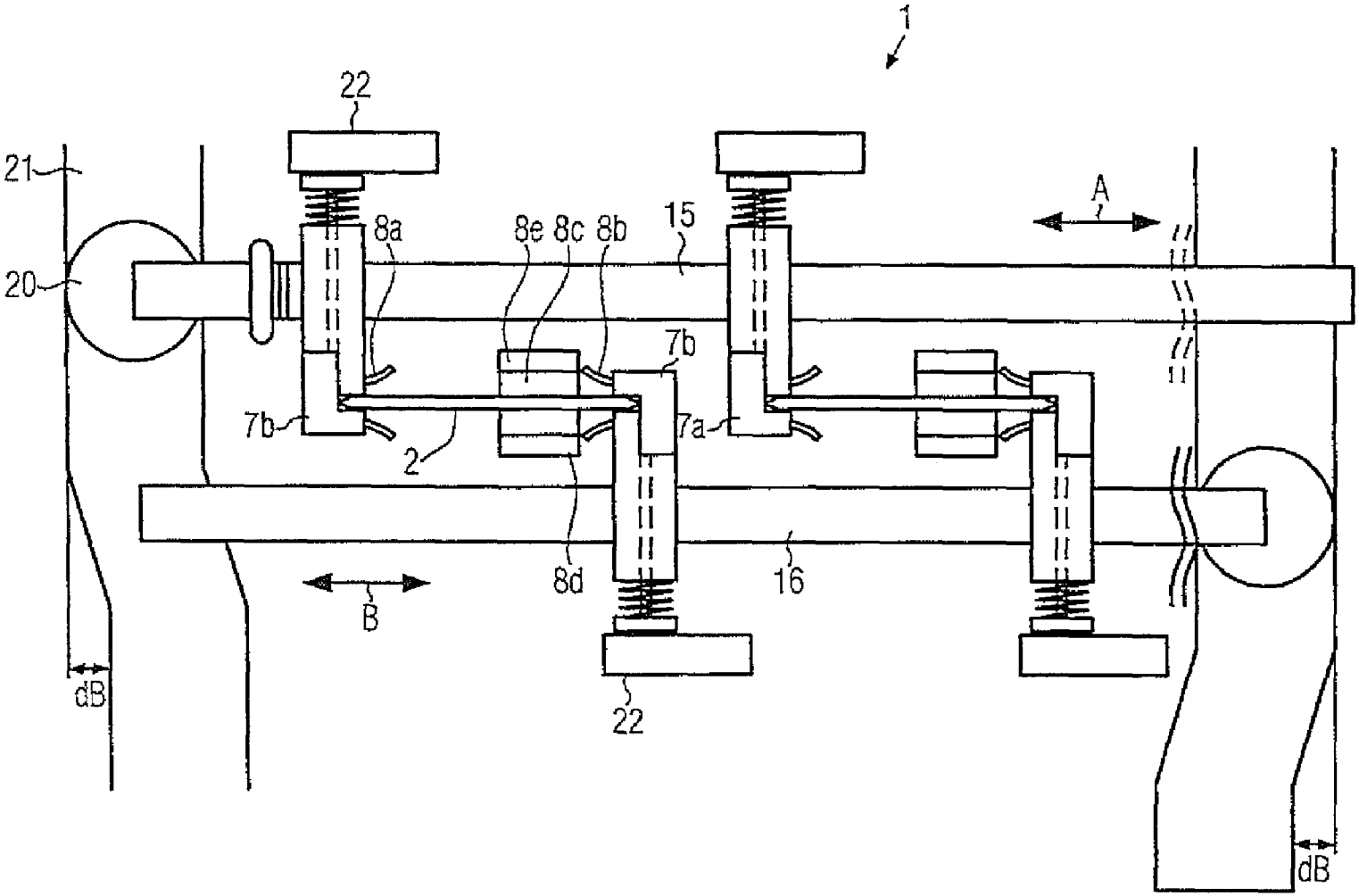
FIG. 4 is a top plan view of the transport system assembly depicted in FIG. 1 transporting a bag of greater width than the bag depicted in FIG. 1.

In order to have an understanding of the instant invention, reference is made to FIGS. 1 and 2 and 4 wherein system 1 comprises a plurality of receptacle assemblies generally indicated at 5, each of which are configured to receive and hold a single pouch 2 and transport the pouch in the direction F. A receptacle assembly is arranged in one row, transversely to a transport direction F to transport the pouches through different handling stations. In the embodiment shown in FIGS. 1 and 4, two of these receptacle assemblies 5 are shown. However, it is understood that in a high-speed assembly line system there are numerous levels of parallel rows and also the device may contain substantially more receptacle assemblies in each row.

Each receptacle assembly is comprised of oppositely arranged holding clamps assemblies, generally indicated at 6, to secure each pouch. Each holding clamp assembly 6 comprises proposed clamp assemblies 7*a* and 7*b* and a support frame which will be described in greater detail below. The holding clamp assembly 6 may also be formed by opposed clamp assemblies 7*a* and 7*b* or may have a support frame 8 only. The clamping assemblies 7*a* and 7*b* correspond to the clamp assemblies described and illustrated in U.S. Pat. No. 6,073,424 and each comprises a stationary clamp block 9 and a gripping part 10 movable relative to the clamp block to form a clamping gap 11 for receiving and clamping the lateral edges 3*a* of each pouch. The gripping part 10 is moved by a plunger 12 into a clamp block 9 in a clamping position by block spring 13, spring loading the gripping part 10 against the block 9. Plunger 12 has a pressure head 14 acting against the spring 13 to cause the gripping part to be closed.

The clamp block 9, the gripping part 10, the clamping gap 11, the plunger 12, the spring 13 and the pressure head 14 are of the same design for both clamp assemblies 7*a* and 7*b* of the holding clamp 6, with both clamp assemblies 7*a* and 7*b* being laterally reversed and arranged to be offset relative to each relative to each other by 180° This construction allows the clamp assemblies to grip lateral edges 3*a* and 3*b* of each pouch from the front and back in the transport direction F.

As is illustrated in FIGS. 1, 2 and 4, clamp assembly 7*a* of the receptacle 5 is fixed to a first carrier 15. Clamp assembly 7*a* is fixedly supported through clamp block 9 to first carrier 15. Similarly clamp assembly 7*b* of the same receptacle is fixed through clamp block 9 to a carrier 16. Elongated carriers 15 and 16 are designed as elongated, bar shaped elements and extend parallel to each other and are mounted to guide poles 23, which are transported along guide links 31 in the direction F and at all times are maintained at a predetermined distance with respect to each other.

Figure 5:
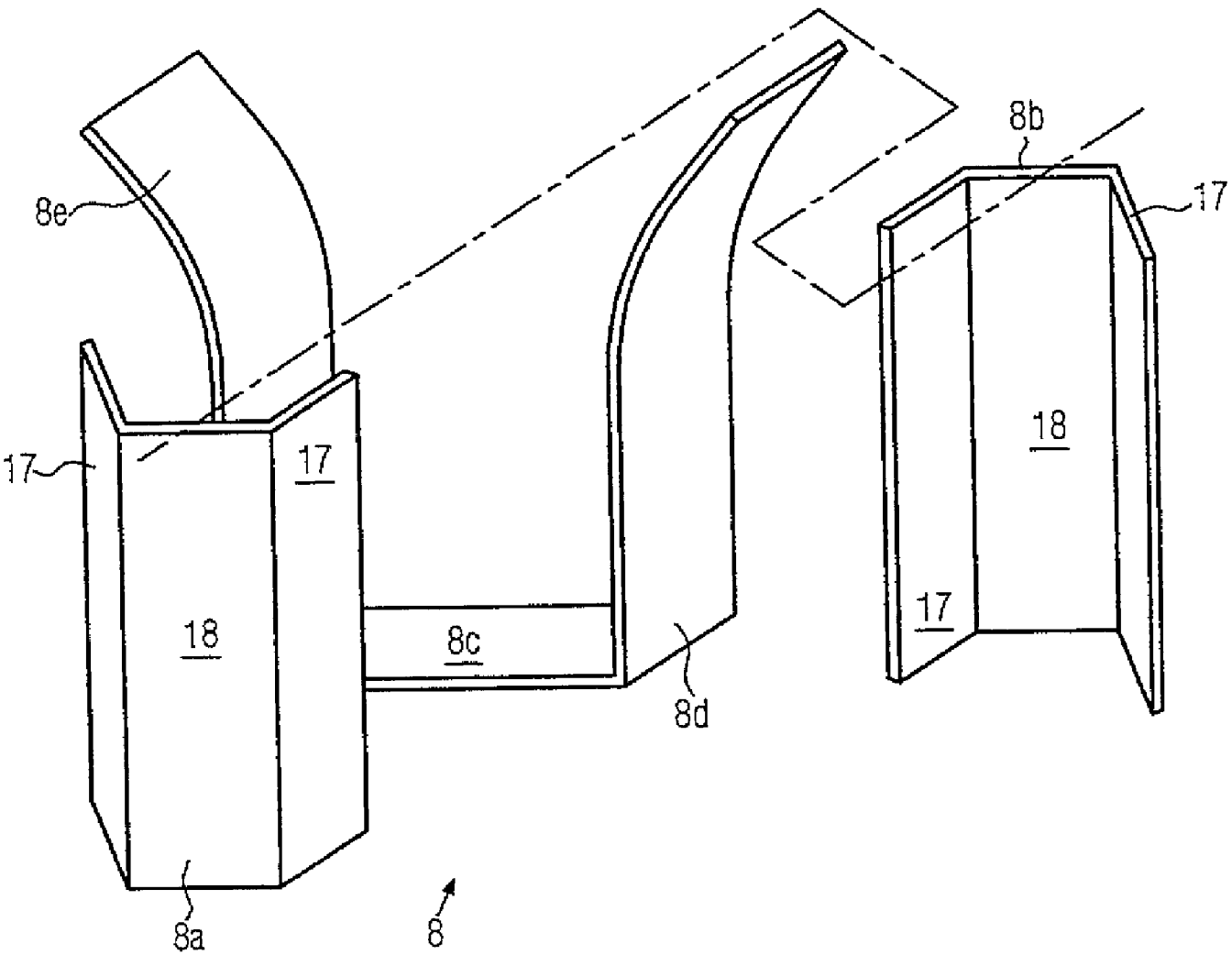
FIG. 5 is a perspective view of the support frames used to assist in holding and securing bags of different widths and heights during transport through different handling stations.

FIG. 5 shows the support frame 8 of each receptacle 5 in more detail and includes two side carriers 8*a* and 8*b* and a bottom carrier 8*c*. In a preferred embodiment bottom carrier 8*c* includes additional side carriers 8*d* and 8*e*, although side carriers 8*d* and 8*e* may not be required if the pouch is not too large. The side carriers 8*a* and 8*b* are designed to hold the lateral edges 3*a*, 3*b* of pouch 2 and have a substantially trapezoidal cross section with lateral wings 17 and holding web 18. Each side carrier 8*a* and 8*b* is supported by elongated carriers 15 and 16 respectively to which the clamp block 9 of the associated clamping assembly 7*a*, 7*b* is connected. A side carrier can be directly coupled to the respective carrier 15 or 16 or by supporting the side carrier on a clamp block 9.

The bottom carrier 8*c* is disposed between clamping assemblies 7*a* and 7*b* but is independent of the two so that it can move independently of the side carriers 8*a* and 8*b*. The bottom carrier 8*c* is fixed to a separate support component (non-shown) by means of which it can be lifted and lowered. That is the bottom carrier 8*c* can be moved independently in the vertical direction to adjust to the height of the pouch. As noted below, the carriers 8*d* and 8*e* which are supported at the leading and trailing end of bottom carrier 8*c* are helpful in supporting the sidewalls 2*a* and 2*b* of the pouch 2 and are positioned at the leading and trailing end of the transport direction F.

Reference is now made to FIGS. 1 through 4 wherein the operation of the transport system of the instant invention in filling a pouch and then to welding the upper edges 4*a* and 4*b* of the pouch together is provided. As described above, an adjustment assembly, generally indicated at 19, is depicted. The adjustment mechanism 19 is depicted as part of the elongated carrier 15 which is connected to the guide rolls 20 for moving the carrier rail 35 and hence the respective elongated carriers 15 and 16 in the transport direction F. Guide roll 23 is a control pulley which travels in guide links 21. In the exemplary embodiment, elongated carriers 15 and 16 are each movable in the direction of the double arrows A, B by means of a control pulley 20 and the restrictions of guide links 31. In the embodiment depicted in FIGS. 1 and 4, the elongated carriers are moved toward each other the distance dB to open the pouch, however, you can obtain such movement by moving or displacing only one of the elongated carriers to obtain the same result.

As described in U.S. Pat. No. 6,073,424, a pusher 22 is provided for each holding clamp assembly 7*a* and 7*b*. The pusher extends parallel to the direction of movement A and B of the respectively adjacent elongated carriers 15 and 16 and is fixed to rotatable rod 23 (FIG. 2) which can be rotated by means of actuating levers 24. The actuating levers may be fixed to the rods 23 at different positions where they can become engaged at the appropriate positions with actuating cams (not shown) when the transport device is moved in the transport direction F. If the actuating lever 24 engages with the actuating cams, the rod 23 and thus the pusher 22 are rotated and pressed against the pressure head 14 of the adjacent clamp assembly 7*a* or 7*b*, respectively. By this pressure the spring is compressed and the gripping assembly 10 is displaced relative to the clamp block 9 to open the clamping gap 11. To close the clamping gap 11, spring 13 presses the gripping part 10 against the clamp block 9, as the pressure head 14 and, hence, plunger 12 is disengaged from the pusher 22.

Figure 3A:
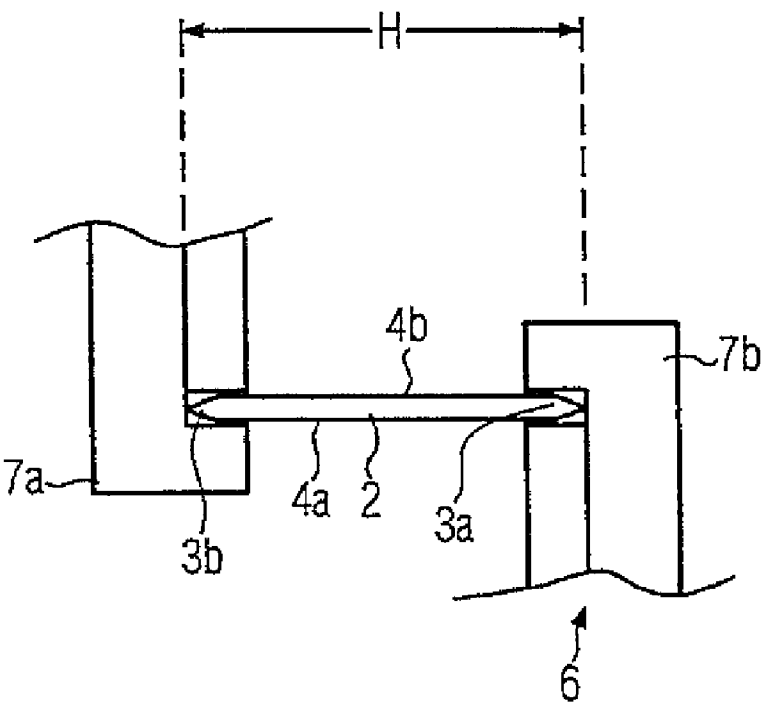

With reference to FIGS. 3*a* and 3*b*, in which only the clamp assemblies 7*a* and 7*b* are shown and the support frame 8 is omitted for ease of understanding, when pouch 2 is closed, two upper edges 4*a* and 4*b* of the sidewalls 2*a* and 2*b* are adjacent to each other as is shown in FIG. 3*a*. The two clamp assemblies 7*a* and 7*b* (and of course also the side carriers 8*a* and 8*b*) must have a holding distance H in which the pouches remain closed, but are not stretched. To open the pouches, the holding means 6 must have an opening distance O which squashes the sides of the pouches so that the front and rear opposed edges 2*a* and 2*b* are bulged as shown in FIG. 3*b*, to permit the pouch to be open and be filled at a filling station.

Accordingly, the opening and closing of the pouches at a distance H, where it remains closed or at a distance O where it remains open is achieved by positioning the guide links 21 in such a way that the pulley displaces the two parallel elongated carriers 15 and 16 toward each other and away from each other so that the holding clamping assembly 6 of each receptacle moves toward each other and away from each other. This displacement is provided by the angled segment 21*a* of the links 21 which caused the carriers 15 and 16 to be displaced by the amount dB in the direction of the double arrows A and B.

Accordingly, the deflection 21*a* in the guide links and the attachment positions of the clamping assemblies 7*a* and 7*b* must be specifically adapted to a particular pouch dimension, namely the width of the pouches between the edges 3*a* and 3*b* to assure proper registry for each pouch as it transported through the different handling devices during assembly and closure.

In order to permit different size pouches to be handled by the machinery without losing any of the precision thereof, an adjustment assembly 26 is provided to permit the holding clamp assembly 6 of the receptacle 5 to be adapted to secure in an open and closed position flexible pouches having different widths.

As illustrated in FIG. 1, this is accomplished by an adjustment assembly, generally indicated as 26 which provides for a first member 15*a* projecting from elongated carrier 15 which includes a row of openings 27 spaced along the length thereof. A second portion 15*b* of elongated carrier 15 is an elongated housing to receive the elongated portion 15 so that 15*a* and 15*b* can be fixedly positioned with respect thereto by an associated locking pin 28 disposed in one of the openings. Each of the spaces between the opening 27 defines steps that are adapted to the dimensions of a particular pouch, i.e., the change in the width of the flexible pouches 2, that are to be handled. By reason of the positioning of the elongated carrier 15*a* and receiving member 15*b* and the change in the length thereof, the side carriers 8*a* which move along with the holding clamp assemblies 7*a* and 7*b* are therefore likewise adapted to different pouch widths between the edges 3*a* and 3*b*. Bottom carrier 8*c* and the side carriers 8*d* and 8*e* may be affixed to the pouches if necessary and may be lifted and lowered independently of the holding clamp assemblies and are used if necessary to provide support from below when larger or taller and hence heavier pouches are handled.

With reference to FIG. 1, clamp assembly 7*a* and side carriers 8*a* are supported by elongated carrier 15 and are displaced simultaneously by the same distance with respect to clamp assemblies 7*b* and side carriers 8*b* which are supported by carrier 16. By this configuration, narrow pouches are shown being secured by the clamping assemblies in FIG. 1 and a wider pouches 2 are secured by the clamping assembly in FIG. 4 where the locking pin has been inserted into the last possible opening 27 in elongated member 27 to permit a wider pouch to be handled. Also, to accommodate pouches of greater width, the bearing surfaces of the pushers 22 of plunger 14 are spaced in the direction of movement A, so that correct opening and closing of the clamps 7*a* and 7*b* occurs irrespective of the width of the pouch.

Accordingly one adjustment mechanism is shown on elongated carrier 15 for shortening or lengthening the width of the pouch to be handled. However, a second adjustment assembly can be incorporated into the second elongated carrier 16 to provide for increased range of adjustment for handling different pouch widths. By this arrangement, neither the adaptor mechanism 25 nor the control pulley 20 which controls clamping angle 21 requires modification and any other alteration to the complex transport system is avoided in transporting pouches of different dimensions. Also, in the embodiments described and illustrated above, the holding clamp mechanism may be comprised of the clamps only or the support frame only to increase the types of pouches and the dimensions of the pouches to be handled. Shape and design of the support frame may be adapted to other pouch shapes. For example, the wings may be extended and the bottom may be formed without the side supports where appropriate.

While there have been shown and described fundamental novel features of the invention as applied to the preferred and exemplary embodiments thereof, it will be understood that the omissions and substitutions and changes in the form and details of the disclosed invention may be made by those skilled in the arts without departing from the spirit of the invention. Moreover, as is readily apparent, numerous modifications and changes may readily occur to those skilled in the art. Hence, it is not desired to limit the invention to the exact construction and operation shown and described and, accordingly all suitable modification equivalents may be resorted to falling within the scope of the invention as claimed. It is the intention, therefore, to be limited as only as indicated to the scope of the claims appended hereto.

What is claimed is:

1. A flexible bag transport system for transporting flexible foil bags through a filling station and a sealing station, the system comprising:

a first holding clamp assembly supported by a first elongated carrier;

a second holding clamp assembly supported by a second elongated carrier, the second elongated carrier being substantially co-lateral to the first elongated carrier, wherein:

the second holding clamp assembly is disposed opposite the first holding clamp assembly for holding a top edge of the foil bag;

the first and second elongated carriers are each disposed on a runner so that each holding clamp assembly is selectively positionable in a manner to be spaced apart so that the first and second holding clamp assemblies are capable of holding the top edge of the foil bag in a first position where the bag is held tight and closed at a sealing station when the first and second holding clamp assemblies are selectively positioned in the first position with respect to each other;

the first and second holding clamp assemblies are selectively displaceable towards each other to a second position so that the bag is opened for filling of the bag; and an adjustment assembly for selectively adjusting the length of the first elongated carrier to accommodate different bag widths without requiring adjustment of the remaining components of the transport system, wherein the adjustment assembly includes a first elongated component and a second elongated component, the first and second elongated components being selectively adjustable with respect to each other to change the length of the first elongated carrier.

2. A flexible bag transport system for transporting flexible foil bags through a filling station and a sealing station, the system comprising:

a first holding clamp assembly supported by a first elongated carrier;

a second holding clamp assembly supported by a second elongated carrier, the second elongated carrier being substantially co-lateral to the first elongated carrier, wherein:

the second holding clamp assembly is disposed opposite the first holding clamp assembly for holding a top edge of the foil bag;

the first and second elongated carriers are each disposed on a runner so that each holding clamp assembly is selectively positionable in a manner to be spaced apart so that the first and second holding clamp assemblies are capable of holding the top edge of the foil bag in a first position where the bag is held tight and closed at a sealing station when the first and second holding clamp assemblies are selectively positioned in the first position with respect to each other;

the first and second holding clamp assemblies are selectively displaceable towards each other to a second position so that the bag is opened for filling of the bag; and an adjustment assembly for selectively adjusting the length of the first elongated carrier to accommodate different bag widths without requiring adjustment of the remaining components of the transport system, wherein the adjustment assembly includes a first elongated component and a second elongated component, the first and second elongated components being selectively adjustable with respect to each other to change the length of the first elongated carrier; and wherein the second elongated component includes an elongated housing for receiving the first elongated component and for allowing the first and second elongated components to be selectively adjusted with respect to each other and thereby adjust the length of the first elongated carrier.

3. A flexible bag transport system for transporting flexible foil bags through a filling station and a sealing station, the system comprising:

a first holding clamp assembly supported by a first elongated carrier;

a second holding clamp assembly supported by a second elongated carrier, the second elongated carrier being substantially co-lateral to the first elongated carrier, wherein:

the second holding clamp assembly is disposed opposite the first holding clamp assembly for holding a top edge of the foil bag;

the first and second elongated carriers are each disposed on a runner so that each holding clamp assembly is selectively positionable in a manner to be spaced apart so that the first and second holding clamp assemblies are capable of holding the top edge of the foil bag in a first position where the bag is held tight and closed at a sealing station when the first and second holding clamp assemblies are selectively positioned in the first position with respect to each other;

the first and second holding clamp assemblies are selectively displaceable towards each other to a second position so that the bag is opened for filling of the bag;

an adjustment assembly for selectively adjusting the length of the first elongated carrier to accommodate different bag widths without requiring adjustment of the remaining components of the transport system, wherein the adjustment assembly includes:

a first elongated component;

a second elongated component;

a locking pin;

wherein the first and second elongated components are selectively adjustable with respect to each other to change the length of the first elongated carrier; and wherein the first elongated component includes a plurality of openings along the length thereof and the locking pin selectively disposable in one of the plurality of openings to adjust the length of the elongated carrier in relationship to the width of the flexible foil bag being transported.

4. A flexible bag transport system for transporting flexible foil bags through a filling station and a sealing station, the system comprising:

a first holding clamp assembly supported by a first elongated carrier;

a second holding clamp assembly supported by a second elongated carrier, the second elongated carrier being substantially co-lateral to the first elongated carrier, wherein:

the second holding clamp assembly is disposed opposite the first holding clamp assembly for holding a top edge of the foil bag;

the first and second elongated carriers are each disposed on a runner so that each holding clamp assembly is selectively positionable in a manner to be spaced apart so that the first and second holding clamp assemblies are capable of holding the top edge of the foil bag in a first position where the bag is held tight and closed at a sealing station when the first and second holding clamp assemblies are selectively positioned in the first position with respect to each other;

the first and second holding clamp assemblies are selectively displaceable towards each other to a second position so that the bag is opened for filling of the bag;

an adjustment assembly for selectively adjusting the length of the first elongated carrier to accommodate different bag widths without requiring adjustment of the remaining components of the transport system; and a support frame to support at least the bottom of the foil bag, wherein the support frame includes a bottom carrier that is selectively vertically adjustable to accommodate foil bags of different heights.

5. A flexible bag transport system for transporting flexible foil bags through a filling station and a sealing station, the system comprising:

a first holding clamp assembly supported by a first elongated carrier;

a second holding clamp assembly supported by a second elongated carrier, the second elongated carrier being substantially co-lateral to the first elongated carrier, wherein:

the second holding clamp assembly is disposed opposite the first holding clamp assembly for holding a top edge of the foil bag;

the first and second elongated carriers are each disposed on a runner so that each holding clamp assembly is selectively positionable in a manner to be spaced apart so that the first and second holding clamp assemblies are capable of holding the top edge of the foil bag in a first position where the bag is held tight and closed at a sealing station when the first and second holding clamp assemblies are selectively positioned in the first position with respect to each other;

the first and second holding clamp assemblies are selectively displaceable towards each other to a second position so that the bag is opened for filling of the bag;

an adjustment assembly for selectively adjusting the length of the first elongated carrier to accommodate different bag widths without requiring adjustment of the remaining components of the transport system; and a support frame to support at least the bottom of the foil bag, wherein the support frame includes at least one side carrier to support a side wall of the foil bag during transport.

6. A flexible bag transport system for transporting flexible foil bags through a filling station and a sealing station, the system comprising:

a first holding clamp assembly supported by a first elongated carrier;

a second holding clamp assembly supported by a second elongated carrier, the second elongated carrier being substantially co-lateral to the first elongated carrier, wherein:

the second holding clamp assembly is disposed opposite the first holding clamp assembly for holding a top edge of the foil bag;

the first and second elongated carriers are each disposed on a runner so that each holding clamp assembly is selectively positionable in a manner to be spaced apart so that the first and second holding clamp assemblies are capable of holding the top edge of the foil bag in a first position where the bag is held tight and closed at a sealing station when the first and second holding clamp assemblies are selectively positioned in the first position with respect to each other;

the first and second holding clamp assemblies are selectively displaceable towards each other to a second position so that the bag is opened for filling of the bag; and an adjustment assembly for selectively adjusting the length of the first elongated carrier to accommodate different bag widths without requiring adjustment of the remaining components of the transport system; and a support frame to support at least the bottom of the foil bag, wherein the support frame includes:

a first side carrier associated with the first holding clamp assembly;

a second side carrier associated with the second holding clamp assembly;

wherein the first side carrier is supported by the first elongated carrier;

the second side carrier is supported by the second elongated carrier; and the first side carrier and second side carrier are each selectively adjustable with respect to a bottom carrier.

* * * * *